US005673615A

United States Patent [19]

Kawakami

[11] Patent Number: 5,673,615

[45] Date of Patent: Oct. 7, 1997

[54] SLIDE CONTROL METHOD IN A HYDRAULIC PRESS

[75] Inventor: Hideaki Kawakami, Komatsu, Japan

[73] Assignees: Komatsu Ltd.; Komatsu Industries Corporation, both of Tokyo, Japan

[21] Appl. No.: 666,568

[22] PCT Filed: Nov. 22, 1995

[86] PCT No.: PCT/JP95/02384

§ 371 Date: Jul. 2, 1996

§ 102(e) Date: Jul. 2, 1996

[87] PCT Pub. No.: WO96/16795

PCT Pub. Date: Jun. 6, 1996

[30] Foreign Application Priority Data

Nov. 29, 1994 [JP] Japan ..... 6-294351

[51] Int. Cl.[6] ..... B30B 15/18

[52] U.S. Cl. ..... 100/35; 100/50

[58] Field of Search ..... 100/35, 43, 48–52

[56] References Cited

U.S. PATENT DOCUMENTS

| | | | |
|---|---|---|---|
| 3,819,774 | 6/1974 | Eggenberger et al. | 100/50 |
| 4,195,563 | 4/1980 | Budraitis et al. | 100/50 |
| 4,367,115 | 1/1983 | Bohn et al. | 100/51 |
| 4,429,627 | 2/1984 | Edsö | 100/35 |
| 4,499,821 | 2/1985 | Clouston | 100/51 |
| 4,784,058 | 11/1988 | Nakagawa et al. | 100/35 |
| 5,176,054 | 1/1993 | Capps | 100/35 |

FOREIGN PATENT DOCUMENTS

| | | | |
|---|---|---|---|
| 1-192500 | 8/1989 | Japan . | |
| 3-47700 | 2/1991 | Japan . | |
| 3-53829 | 11/1991 | Japan . | |
| 4-2360 | 1/1992 | Japan . | |
| 4-22600 | 1/1992 | Japan | 100/48 |
| 5-269600 | 10/1993 | Japan | 100/48 |
| 1756175 | 8/1992 | U.S.S.R. | 100/48 |
| 2026382 | 2/1980 | United Kingdom | 100/51 |

*Primary Examiner*—Stephen F. Gerrity

*Attorney, Agent, or Firm*—Frishauf, Holtz, Goodman, Langer & Chick

[57] ABSTRACT

A hydraulic press for moving a slide up and down by the use of a hydraulic cylinder, the slide is lowered from a descending region to a molding region while its position is controlled on the basis of a position signal detected by slide position detector, and a pressure signal obtained from a pressure detector for detecting the pressing force of the slide is compared with a predetermined capacity set in accordance with a machining condition in this molding region. If the set capacity is not reached, the slide is made to continue its descent to a lower dead point while effecting successively the position control and holding it at that position for a set time. When the set capacity is reached, pressure control instead of position control is carried out and the pressure is held for the set time.

2 Claims, 4 Drawing Sheets

SLIDE CONTROL METHOD IN A HYDRAULIC PRESS

TECHNICAL FIELD

The present invention relates to a slide control method in a hydraulic press in which a slide is moved up and down with a hydraulic pressure.

BACKGROUND ART

Press machines in the prior art are classified into a mechanical press in which the slide is moved up and down by a crank mechanism or a link mechanism and a hydraulic press in which the slide is moved up and down with a hydraulic pressure. It has been recognized that the hydraulic press is advantageous in that the motion of the slide can freely be changed in accordance with pressing conditions.

It may also be noted that a variety of methods and devices have been proposed for controlling the slide in the hydraulic press in the prior art.

For example, in Japanese Examined Utility Model Publication No. Hei 03-53829, there is proposed an apparatus for detecting a completion of the pressurizing step in the hydraulic press in which the completion of the pressurizing step is accurately detected by making a discrimination as to whether a slide descending velocity becomes equal to or lower than a predetermined reference velocity for discriminating a stop of the slide in the pressurizing step, timing with a timer means the predetermined time period of a pressure rise from a point of time at which the said slide descending velocity has been discriminated to be equal to or lower than the said reference velocity, setting the said reference velocity for the said slide stop discrimination at a value that is close substantially to the zero and setting the said time period of pressure rise to coincide with a time period that is required from the point of time at which the said slide descending velocity becomes approximately the zero to the point of time at which the applied pressure becomes a set pressure.

Also, in Japanese Unexamined Patent Publication No. Hei 01-192500, there is proposed a control method in the hydraulic press in which the velocity of movement in a hydraulic cylinder is controlled until the pressing of a workpiece is initiated and the applied pressure in the hydraulic press is controlled after the pressing of the workpiece has been commenced.

Further, in Japanese Examined Patent Publication No. Hei 04-2360, there is proposed a hydraulic pressing apparatus in which a movable platen is pressed against a fixed platen with a pressure cylinder, and a given workpiece is controlledly pressed in accordance with a preset program between a pair of pressing plates which are disposed between the said fixed platen and the said movable platen. And, the said apparatus comprises a detecting means being provided with a hydraulic sensor for detecting a hydraulic pressure of the operating fluid in a pressing cylinder as noted above and detecting an arrival of the above mentioned movable platen at a given pressing commencement position, a bearing pressure control means for being composed of an electromagnetic relief valve that is connected to a feed path for the operating fluid into the above mentioned pressing cylinder and controlling the hydraulic pressure of the operating fluid that is supplied into the said pressing cylinder in accordance with a preset bearing control pattern so as to control the bearing pressure acting on the above mentioned workpiece, a distance control means being composed of an electromagnetic flow rate control valve that is connected to the feed path for the operating fluid into the above mentioned pressing cylinder and controlling the rate of flow of the operating fluid into the said pressing cylinder in accordance with a preset plate thickness control pattern, thereby controlling the distance between the above mentioned pressing plates. Thus, in the operation of the said apparatus, the above mentioned detecting means will be operative to detect an arrival of the above mentioned movable platen at the above mentioned pressing commencement position to initiate an pressing control as noted above while one of the bearing pressure control means and the distance control means mentioned above will act as a limiter for the other so that either the bearing pressure acting on the said above mentioned workpiece or the distance between the above mentioned pressing surfaces may have a limitation and the said pressing control may be carried out by controlling the said bearing pressure or the said distance between the said pressing plates with the other one of the said distance control means and the said bearing pressure control means.

If, however, an apparatus as disclosed in Japanese Unexamined Utility Model Publication No. Hei 03-53829 is adopted which is designed to detect the slide velocity in the vicinity of its lower dead point becoming approximately the zero and to detect, after the passage of a given time period, the pressing step having completed, it has been found that owing to the fact that neither the position of the slide dead point nor the applied pressure is positively controlled, if there is a dispersion in respect of the thicknesses of workpieces, not only is it incapable of retaining an accuracy at the lower dead point of the slide but there ensues an inconvenience that a high precision forming is seldom attained since a predetermined applied pressure is not obtainable at the lower dead point.

Also, in an apparatus as disclosed in Japanese Unexamined Patent Publication No. Hei 01-192500 which is designed to detect the slide velocity in the vicinity of the lower dead point becoming approximately the zero so as to effect a switching from the velocity control to the pressure control, it has also been found that if there is an dispersion in respect of the thicknesses of workpieces or the like, not only is it incapable of retaining an accuracy at the lower dead point of the slide but there ensues an inconvenience that a high precision forming result is seldom attained since a predetermined applied pressure may not be obtainable at the lower dead point.

Further, in an apparatus as disclosed in Japanese Examined Patent Publication No. Hei 04-2360 in which the position control of the slide is effected with a positional sensor and an electromagnetic flow rate control valve whereas its pressure control is performed by a pressure sensor and an electromagnetic relief valve so that the position control and the pressure control for the slide may be carried out with their respective mechanisms which are entirely independent from each other, it has been found that there results an inconvenience that its construction tends to be complicated and to be highly expensive.

The present invention is provided to remove such conventional inconveniences and has its object to provide a slide control method in a hydraulic press which enables a high precision forming operation to be carried out by controlling the motion of a slide in a pair of control modes which comprise a position control mode and a pressure control mode.

SUMMARY OF THE INVENTION

In order to achieve the object mentioned above, there is provided in accordance with the present invention, in a first of the embodiments thereof, a slide control method in a hydraulic press in which a slide is moved up and down with a hydraulic cylinder, which method comprises the steps of: detecting a position of the said slide with a slide position detecting means; descending the said slide from a descending zone into a forming zone while effecting a position control of the said slide in response to a positional signal output by the said slide position detecting means; detecting a pressure applied on the said slide in the said forming zone with a pressure detecting means to derive a pressure signal therefrom; comparing the said pressure signal with a signal representative of a set pressure capacity that is predetermined in accordance with a given pressing condition; in case the said applied pressure is found not to have reached the said set pressure capacity in the preceding comparison step, continuing to effect the said position control while descending the said slide down to a lower dead point, and maintaining the position thereof at the said lower dead point for a preset period of time; and in case the said applied pressure in the said forming zone is found to have reached the said set pressure capacity in the said comparison step, effecting switching in a control mode from a mode of the said position control to a mode of a pressure control and maintaining a pressure in the said pressure control mode for the said preset period of time.

There is also provided in accordance with the present invention, in a second of the embodiments thereof, a slide control method in a hydraulic press in which a slide is moved up and down with a hydraulic cylinder, which method comprises the steps of: detecting a position of the said slide with a slide position detecting means; descending the said slide from a descending zone into a forming zone while effecting a position control of the said slide in response to a positional signal output by the said slide position detecting means; detecting a pressure applied on the said slide in the said forming zone with a pressure detecting means to derive a pressure signal therefrom; comparing the said pressure signal with a signal representative of a set pressure capacity that is predetermined in accordance with a given pressing condition; in case the said applied pressure is found not to have reached said set pressure capacity in the preceding comparison step, continuing to effect the said position control while descending the said slide down to a lower dead point, and maintaining the position thereof at the said lower dead point for a preset period of time; in case said applied pressure in the said forming zone is found to have reached the said set pressure capacity in the said comparison step, effecting switching in a control mode from a mode of the said position control to a mode of a pressure control and maintaining a pressure in the said pressure control mode for the said preset period of time; and if the said pressure during the said pressure control mode is lowered to be below the said set pressure capacity, repeating in the said forming zone an operation for switchingly restoring the said position control mode.

According to the methodical construction mentioned above, by virtue of the fact that the slide is descended down to the said lower dead point in the said position control mode in case the pressure being applied to the said slide in the forming zone is not found to have reached the said set pressure capacity, it can be seen that an accuracy at the said lower dead point of the slide will be enhanced.

Also, by virtue of the fact that in case the pressure being applied on the slide in the said forming zone is found to have reached the said set pressure capacity, the control mode is switched from the said position control mode to the said pressure control mode so as to maintain the pressure in the said pressure control mode for the said present period of time, it will be seen that the thickness of a workpiece in a draw forming operation and so forth can be prevented from becoming thinner than as needed.

BRIEF EXPLANATION OF THE DRAWINGS

The present invention will better be understood from the following detailed description and the drawings attached hereto showing certain illustrative embodiments of the present invention. In this connection, it should be noted that such embodiments as illustrated in the accompanying drawings are intended in no way to limit the present invention, but to facilitate an explanation and understanding thereof. In the accompanying drawings.

BEST MODES FOR CARRYING OUT THE INVENTION

Hereinafter, suitable embodiments of the present invention with respect to a slide control method will be set forth with reference to the accompanying drawings hereof.

An explanation will now be given with respect to a certain embodiment of the present invention with reference to the accompanying drawings hereof.

Figure 1:
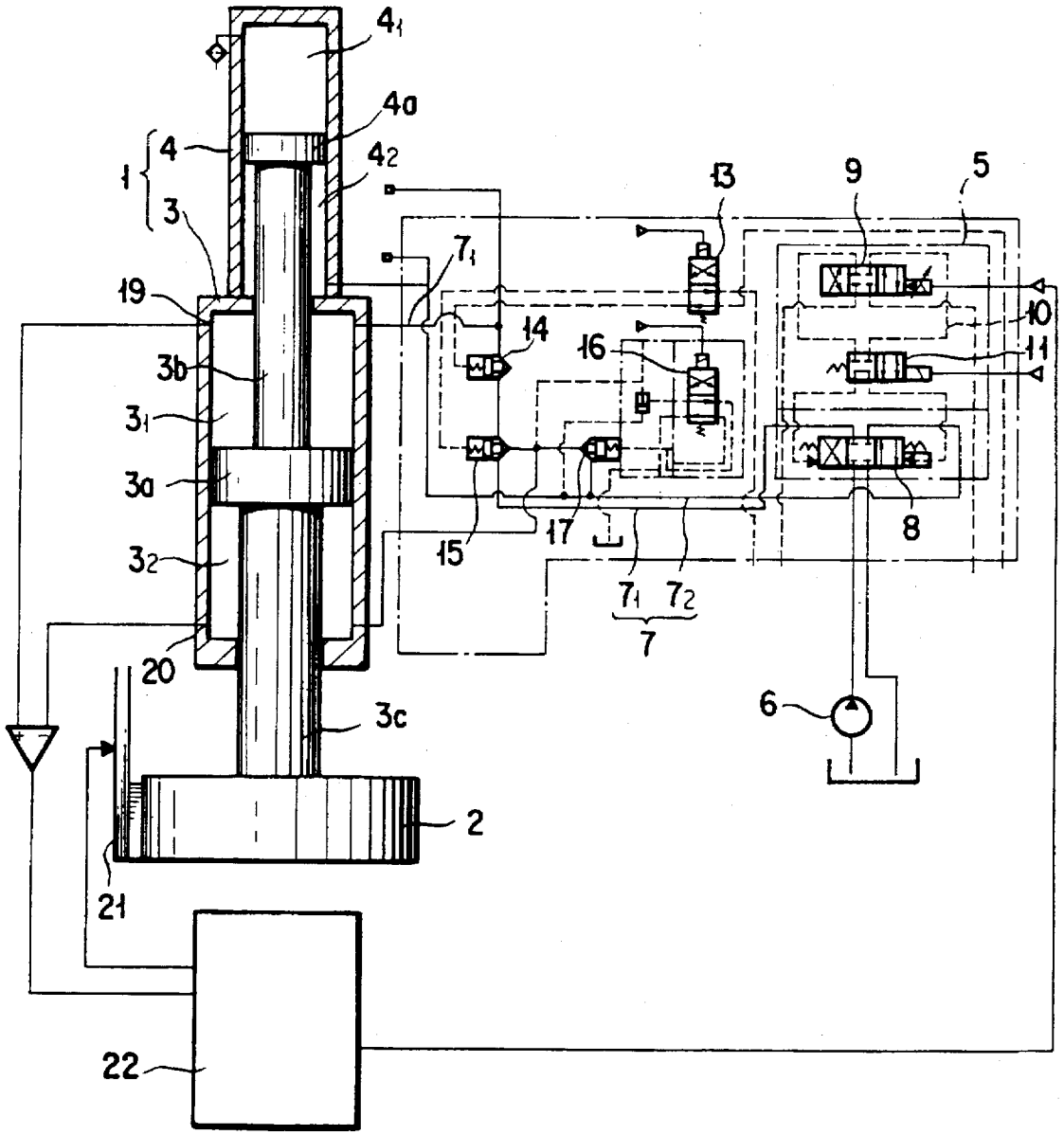
FIG. 1 is a hydraulic circuit diagram for a hydraulic press that can be used in practicing a certain embodiment of the slide control method according to the present invention.
Figure 2:
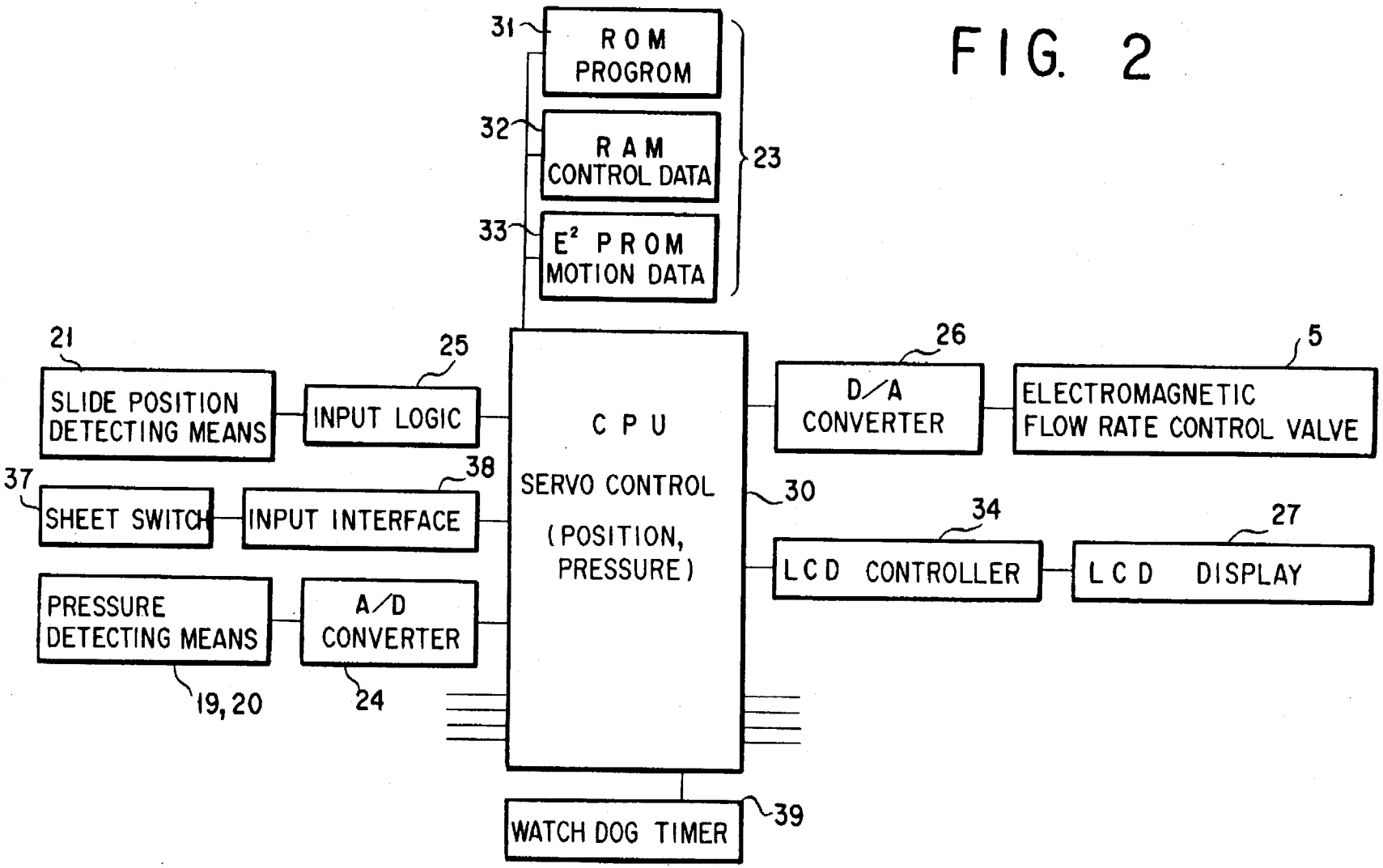
FIG. 2 is a block diagram illustrating the interior of a controller for the hydraulic press shown in FIG. 1.

FIG. 1 is a circuit diagram showing a hydraulic circuit in a rotary press, and FIG. 2 is a block diagram showing the interior of a controller.

In FIG. 1, numeral 1 designates a hydraulic cylinder for moving a slide 2 upwards and downwards. The said hydraulic cylinder 1 comprises a first cylinder 3 having a greater diameter and a second cylinder 4 having a smaller diameter and which is mounted upon the said first cylinder 3 concentrically therewith. And, piston rods **3*b* and 3*c* are provided as projecting upwards and downwards from the upper and lower surfaces of a piston 3*a*, respectively, which is received in the said first cylinder 3**.

It will be seen that the said piston rod **3*b* that is provided as projecting upwards from the upper surface of the said piston 3*a* is dimensioned to be smaller in diameter than the said piston rod 3*c* that is provided as projecting downwards from the lower surface of the said piston 3*a*. It will also be seen that the upper end side of the said piston rod 3*b* is projected into the said second cylinder 4 and is provided at its end portion with a piston 4*a* that is securely attached thereto and that is received in the said second cylinder 4 whereas the above mentioned slide 2 is securely attached to the lower end of the said piston rod 3*b* that is provided as projecting downwards from the lower surface of the said piston 3*a***.

Also, it should be noted in FIG. 1 that numeral 5 represents an electromagnetic flow rate control valve which is constructed of a servo valve 8 that is disposed midway of a pipe conduit assembly 7 for applying a discharge pressure of a hydraulic pump 6 to the first cylinder 3 and the said second cylinder 4 mentioned above, an electromagnetic control valve 9 for pilot controlling the said servo valve 8, and an on/off valve 11 that is disposed midway of a pilot circuit 10 for connecting between the said electromagnetic valve 9 and the said servo valve 8.

And, it will be seen that the pipe conduit assembly 7 for connecting between the above mentioned servo valve 8 and the said first cylinder 3 is comprised of a first pipe conduit $7_1$ and a second pipe conduit $7_2$ and that the first pipe conduit $7_1$ that is connected to the side of an upper chamber $3_1$ of the said first cylinder 3 and a lower chamber $3_2$ of the said first cylinder 3 are connected together via a pair of logic valves 14 and 15 that can be opened and closed by an electromagnetic valve 13 whereas the said one logic valve 15 and the said second pipe conduit $7_2$ that is connected to a lower chamber $4_2$ of the said second cylinder 4 are connected together via a logic valve 17 that can be opened and closed by an electromagnetic valve 16, the said cylinder 4 having an upper chamber $4_1$ that is opening to the atmosphere.

On the other hand, it should be noted that to the said upper chamber $3_1$ and the said lower chamber $3_2$ of the above mentioned first cylinder 3 there are connected a pair of pressure detecting means 19 and 20, respectively, each comprising a pressure sensor for detecting a pressure P applied within each chamber $3_1$, $3_2$ whereas in the vicinity of the said slide 2 there is provided a slide position detecting means 21 for detecting the position of the said slide 2 and that pressure and positional signals output by these detecting means 19, 20 and 21 are entered into a controller 22.

As shown in FIG. 2, the above mentioned controller 22 are constructed of a CPU 30; a storage means 23 comprising a ROM 31 in which a control program has been preliminarily stored, a RAM 32 for storing a control data and $E^2$PROM 33 for storing a motion data; an interface 24 comprising an A/D converter for A/D converting the signals output by the pressure detecting means 19 and 20 for entry into the CPU 30; an input interface 38 for entering into the CPU 30 a signal of a sheet switch 37 for data entry; an interface 25 comprising an input logic for entering the signal output by the slide position detecting means 21 such as a positional sensor into the CPU 30, an D/A converter 26 for D/A converting the control signals furnished from the CPU 30 in order to furnish converted control signals into the above mentioned electromagnetic flow rate control valve 5; a display means 27 for displaying a control state via an LCD controller 34; and a watch dog timer 39 for monitoring the processing time period of the CPU 30 and judging that the CPU 30 is in a failure in response to its exceeding a normal processing time period.

Figure 3:
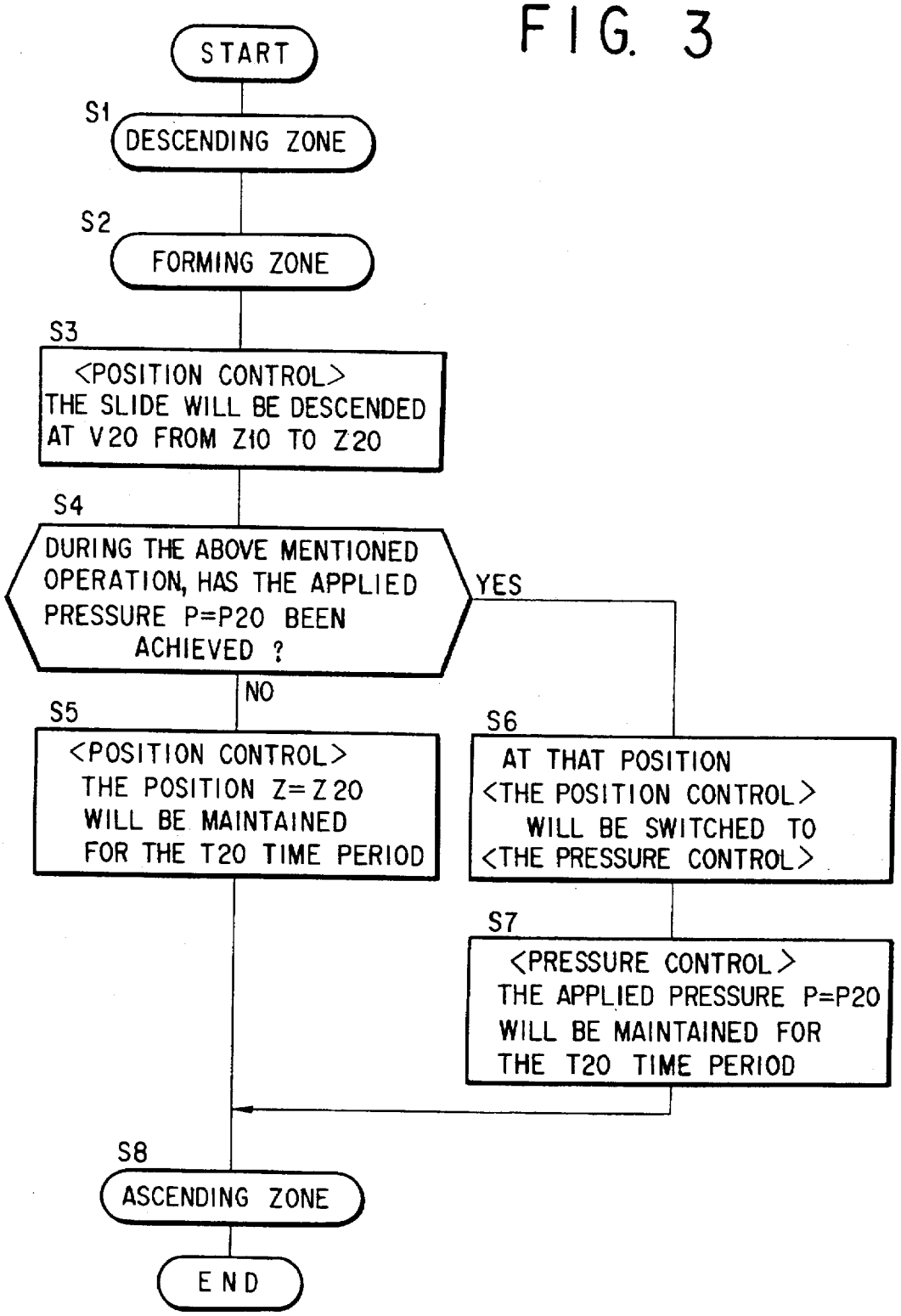
FIG. 3 is a flow chart illustrating the procedure that is involved in the above mentioned embodiment of the present invention.
Figure 4:
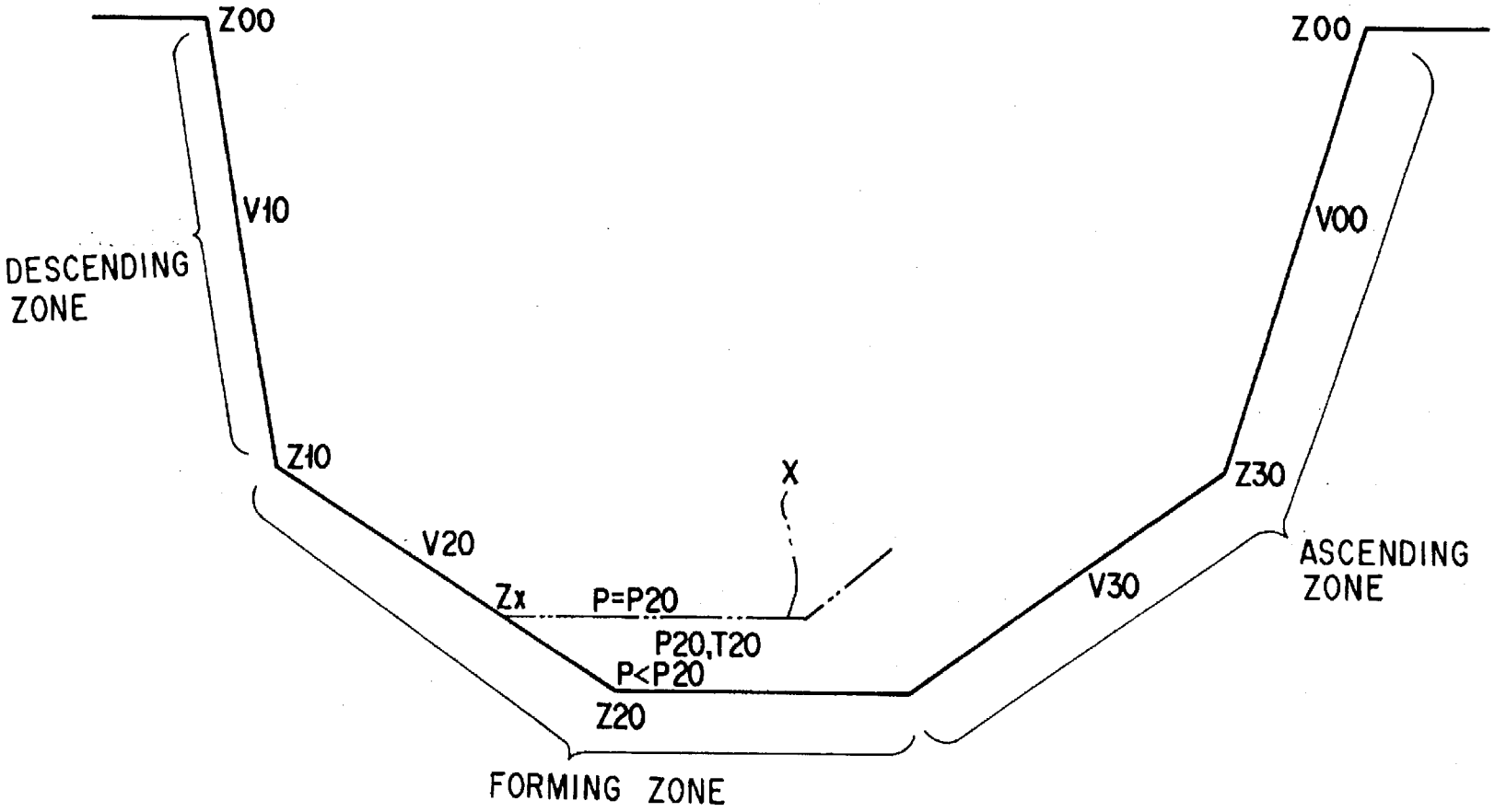
FIG. 4 is a schematic diagram illustrating the motion of a slide in the hydraulic press according to the above mentioned embodiment of the present invention.

An explanation will next be made with respect to a motion control operation for the said slide 2 by means of the above mentioned controller 22 with reference to FIGS. 3 and 4.

In forming a workpiece in the press, what will first be done is to set up the positional data Z00~Z30, the velocity data V00~V30, the pressure capacity data P20 and the pressure maintaining time period T20 and so forth, which shall be setting parameters with respect to the motion of the slide 2 (See FIG. 4) and to have them entered using the sheet switch 37.

Next, the hydraulic press commences to be operated upon receiving an actuating signal from an operating button (not shown) to switch the said electromagnetic flow rate control valve 5. Since the said logic valves 14 and 15 at the same time are opened by the said electromagnetic valve 13, a pressurized discharge fluid of the said hydraulic pump 6 will be fed from the said servo valve 8 via the said first pipe conduit $7_1$ and the said logic valves 14 and 15 to reach the said upper chamber $3_1$ of the said first cylinder 3. At the same time, since the fluid in the said lower chamber $3_2$ of the said first cylinder 3 is merged with the pressurized discharge fluid of the said hydraulic pump 6 and then the merged fluid is fed into the said upper chamber $3_1$ of the said first cylinder 3, the said piston 3*a* will be thrusted downwards owing to a difference between pressure receiving areas of the said upper chamber $3_1$ and the said lower chamber $3_2$ so that the said slide 2 may commence to move downwards at a preset high velocity V10 from an upper dead point Z200 as shown in FIG. 4 (in the step S1 of the flow chart shown in FIG. 3).

The pressures within the said upper chamber $3_1$ and the said lower chamber $3_2$ of the said first cylinder 3 in a descending zone of the said slide 2 will constantly be detected by the said pressure detecting means 19 and 20 whereas the position of the said slide 2 will constantly be detected by the said slide position detecting means 21 so that they may be entered into the said controller 22.

Subsequently, if the said slide 2 is moved down to a forming zone initiation point Z10 to reach the forming zone for the workpiece (in the step S2), the slide motion control operation will thereafter be executed by the said electromagnetic flow rate control valve 5 in the position priority mode and the pressure priority mode in a manner as mentioned below.

More specifically, when the said slide 2 is moved downwards and reaches the said forming zone initiation point Z10 to enter into the said forming zone, the said controller 22 will, in accordance with a positional signal entered by the said slide position detecting means 21, act to control the degree of opening of the electromagnetic flow rate control valve 5 and will thereby allow the said slide 2 to be descended at a preset velocity V20 down to a lower dead point position Z20 while being controlled in position (the step S3).

In the mean time, the said controller 20 will determined whether or not a difference in pressure (PH−PL) that is fed from the said pressure detecting means 19 and 20 in the step 4 has reached a preset pressure data P20 and, in a case where the detected pressure is found not to have reached the preset value P20 by the time when the said slide 2 reaches the said lower dead point position Z20, will act to maintain the said slide 2 at the said lower dead point position Z20 for a preset period of time T20 in the step 5.

More specifically, in a time interval from the said forming zone initiation point Z10 to the said lower dead point Z20, the said slide 2 will reach the said lower dead point Z20 at the said preset descending velocity V20. Thereafter, the said slide 2 will proceed to the step S8 and will then be shifted into an ascending zone.

On the other hand, in a case where the pressure P detected by the said pressure detecting means 19 and 20 in the time interval of forming from the forming zone initiating point Z10 to the said lower dead point Z20 has reached the said preset pressure capacity P20, the said slide will advance from the step 4 to the step 6 where the control mode will be switched from the position control mode to the pressure control mode.

More specifically, when the said controller 20 has detected the applied pressure P becoming equal to the said preset pressure capacity P20, the control mode will be switched from the position control mode to the pressure control mode where the degree of opening of the said electromagnetic flow rate control valve 5 will be controlled so that the applied pressure P=P20 may be maintained for the preset period of time T20 (the step S7).

This will cause the said slide 2 to be maintained at the descending position Zx for the said T20 time period and thereafter to proceed to the step 8 so as to be shifted into the said ascending zone as shown by the phantom line (x).

In the ascending zone of the step S8, the said slide 2 in both the position control mode and the pressure control mode will be ascended by virtue of the position control at a preset low velocity V30 until it reaches an ascending position Z30. Thereafter, the said slide 2 will be ascended at a preset high velocity V00 up to the upper dead point Z00 where a single cycle will be completed.

As set out in the foregoing, it can be seen that since in a case where the pressure P applied on a slide 2 in a forming zone is found not to have reached a said set pressure capacity P20, a workpiece will be formed by the slide 2 which is controlled in its position down to a said lower dead point, the method described is effective in performing a forming operation such as a marking process in which a high accuracy at such a lower dead point is required. Since a set value for the said lower dead point serves as a limiter as well, it can also be seen that no more thrusting pressure against a die will be required than as would be needed, thereby clearing up any fear whatsoever that the die might be broken.

Also, since in a case where the pressure P applied on a slide 2 in a forming zone is found to have reached a said set pressure capacity P20, the control mode is switched to a said pressure control mode so as to control the pressure being applied on the slide 2, it will also be seen that the thickness of a workpiece can be prevented from becoming thinner than as will be required in a squeezing operation and so forth and that an improvement in the dimensional accuracy of a workpiece can be achieved as well.

While in the embodiment set out above the control mode is switched from the position control mode to the pressure control mode so as to perform a forming operation in a case where the pressure P applied in the forming zone is found to have reached the said preset pressure capacity P20, it should be noted at this point that in a case where the pressure P being, applied in the pressure control mode is lowered to be below the said preset pressure capacity P20, the position control mode can be switchingly restored so as to again perform the position controlling operation. Then, of course, the position control mode and the pressure control mode can be repeated several times.

As described in the foregoing, according to the present invention in which the pressure applied to a slide that has be lowered from a descending zone to a forming zone by controlling the position thereof is detected by a pressure detecting means to derive a pressure signal therefrom; the pressure signal so obtained is compared with a signal representative of a set pressure capacity that is determined preliminarily in accordance with a given pressing condition; in case the pressure being applied is found not to have reached the said set pressure capacity in the said comparison, the said slide is descended down to a lower dead point while being continuingly controlled in its position to perform a forming operation; and in case the pressure being applied in the above mentioned forming zone is found to have reached the said set pressure capacity in the said comparison, the control mode is switched from the position control mode to a pressure control mode so as to control the motion of the said slide, it can be seen that since a high precision for the said lower dead point is obtained in a forming operation in the said position control mode, a workpiece can be pressed with a depth which is made constant and that since a preset value for the said lower dead point functions as a limiter, the inconvenience will be resolved that a die might be broken as a result of applying to the die a pressing force that is greater than as is needed.

Also, since the pressure that is applied in a forming operation which is carried out in a said pressure control mode is positively controlled, it will further be seen that the thickness of a workpiece can be prevented from becoming thinner than as will be required in a squeezing process and so forth. It addition, it will be recognized that a dimensional accuracy can be improved of a formed product which will thus be obtainable with an enhanced quality.

While the present invention has hereinbefore been described with respect to certain illustrative embodiments thereof, it will readily be appreciated by a person skilled in the art to be obvious that many alterations thereof, omissions therefrom and additions thereto can be made without departing from the essence and the scope of the present invention. Accordingly, it should be understood that the present invention is not limited to the specific embodiments thereof set out above, but includes all possible embodiments thereof that can be made within the scope with respect to the features specifically set forth in the appended claims and encompasses all equivalents thereof.

What is claimed is:

1. A slide control method in a hydraulic press in which a slide is moved up and down with a hydraulic cylinder, comprising the steps of:

detecting a position of said slide with a slide position detector;

descending said slide from a descending zone into a forming zone while effecting a position control of said slide in response to a positional signal output by said slide position detector;

detecting a pressure applied on said slide in said forming zone with a pressure detector to derive a pressure signal therefrom;

comparing said pressure signal with a signal representative of a set pressure capacity that is predetermined in accordance with a given pressing condition;

in case said applied pressure is found not to have reached said set pressure capacity in said comparing step, continuing to effect said position control while descending said slide down to a lower dead point, and maintaining the position thereof at said lower dead point for a preset period of time; and in case said applied pressure in said forming zone is found to have reached said set pressure capacity in said comparing step, effecting switching in a control mode from a mode of said position control to a mode of a pressure control and maintaining a pressure in said pressure control mode for said preset period of time.

2. A slide control method in a hydraulic press in which a slide is moved up and down with a hydraulic cylinder, comprising the steps of:

detecting a position of said slide with a slide position detector;

descending said slide from a descending zone into a forming zone while effecting a position control of said slide in response to a positional signal output by said slide position detector;

detecting a pressure applied on said slide in said forming zone with a pressure detector to derive a pressure signal therefrom;

comparing said pressure signal with a signal representative of a set pressure capacity that is predetermined in accordance with a given pressing condition;

in case said applied pressure is found not to have reached said set pressure capacity in said comparing step, continuing to effect said position control while descending said slide down to a lower dead point, and maintaining the position thereof at said lower dead point for a preset period of time;

in case said applied pressure in said forming zone is found to have reached said set pressure capacity in said comparing step, effecting switching in a control mode from a mode of said position control to a mode of a pressure control and maintaining a pressure in said pressure control mode for said preset period of time; and if said pressure during said pressure control mode is lowered to be below said set pressure capacity, repeating in said forming zone an operation for switchingly restoring said position control mode.

* * * * *